United States Patent [19]

Fougere

[11] Patent Number: 4,907,162

[45] Date of Patent: Mar. 6, 1990

[54] SYSTEM FOR INDICATING THE BALANCE OF STORED VALUE

[75] Inventor: Guy L. Fougere, Easton, Conn.

[73] Assignee: Pitney Bowes, Stamford, Conn.

[21] Appl. No.: 74,423

[22] Filed: Jul. 16, 1987

[51] Int. Cl.[4] ..... G07B 17/00

[52] U.S. Cl. ..... 364/464.02; 364/519

[58] Field of Search ..... 364/464, 466, 518, 519, 364/464.02

[56] References Cited

U.S. PATENT DOCUMENTS

| | | | |
|---|---|---|---|
| 4,168,533 | 9/1979 | Schwartz | 364/900 |
| 4,675,841 | 6/1987 | Check, Jr. et al. | 364/900 |
| 4,725,718 | 2/1988 | Sansone et al. | 235/495 |
| 4,743,747 | 5/1988 | Fougere et al. | 235/494 |
| 4,760,532 | 7/1988 | Sansone et al. | 364/464 |
| 4,760,534 | 7/1988 | Fougere et al. | 364/464 X |

*Primary Examiner*—Parshotam S. Lall
*Assistant Examiner*—Edward R. Cosimano
*Attorney, Agent, or Firm*—Donald P. Walker; Melvin J. Scolnick; David E. Pitchenik

[57] ABSTRACT

A system for indicating the balance of stored value includes a computer and a memory having preselected stored values therein, each preselected stored value having an address corresponding to an address of a graphic pattern instruction set.

12 Claims, 3 Drawing Sheets

SYSTEM FOR INDICATING THE BALANCE OF STORED VALUE

BACKGROUND OF THE INVENTION

The present invention generally relates to a system for indicating the balance of stored value and, in particular, relates to such a system having means for altering an indicia that represents value.

The use of an indicia that represents a monetary value has become more prevalent due, in part, to the increased availability of electronic funds transfer systems as well as the increased use and availability of electronic telecommunication networks. Further, as the implementation of desk-top, or personal, computers and/or workstations increases, the ability to rapidly dispense such funds has also increased. In one particular industry, to wit: the mailing industry, modern systems thereof are able to process a substantial volume of mail in a relatively short time period. In many such systems there is a postage value storage device, usually secure, wherein a purchased value of postage is stored. The purchased value of postage is depleted as mail is processed. Hence, because mail can be processed rapidly, the purchased value of postage can also be depleted quite quickly. Consequently, some modern mailing systems are provided with a mechanism for automatically initiating the replenishing of funds via an electronic fund transfer. However, numerous postal related systems remain that do not have any form of automatic refunding.

In those systems that lack an automatic refunding capability the operator thereof frequently maintains a record of the remaining postage value available to be used. Failure to maintain such a record can result in the postage funds available to be used being insufficient to continue with a mailing program. This could result in an untimely interruption of work flow until additional funds were secured. In many businesses that process a large volume of mail, such an interruption would be, at the very least, inconvenient and possibly quite costly as well, since, as a result of the shutdown of a mailing system, operator time as well as equipment time would be lost. Further, in those systems to do include automatic refunding, it is often desirable for the operator to be alerted that such a refunding is about to occur so that the interruption of the mailing system can be minimized. Consequently, a system for indicating, for example, to a mail system operator, the balance of stored value is needed to avoid costly interruptions during the processing of mail.

SUMMARY OF THE INVENTION

Accordingly, it is one object of the present invention to provide a system for indicating the balance of a stored value.

This object is accomplished, at least in part, by a system having means for altering an indicia in response to a particular value of stored funds being reached, usually by depletion of a previously higher value of funds.

Other objects and advantages will become apparent to those skilled in the art from the following detailed description read in conjunction with the appended claims and the drawings attached hereto.

BRIEF DESCRIPTION OF THE DRAWINGS

The drawing, not drawn to scale, includes.

DETAILED DESCRIPTION OF THE INVENTION

Figure 1:
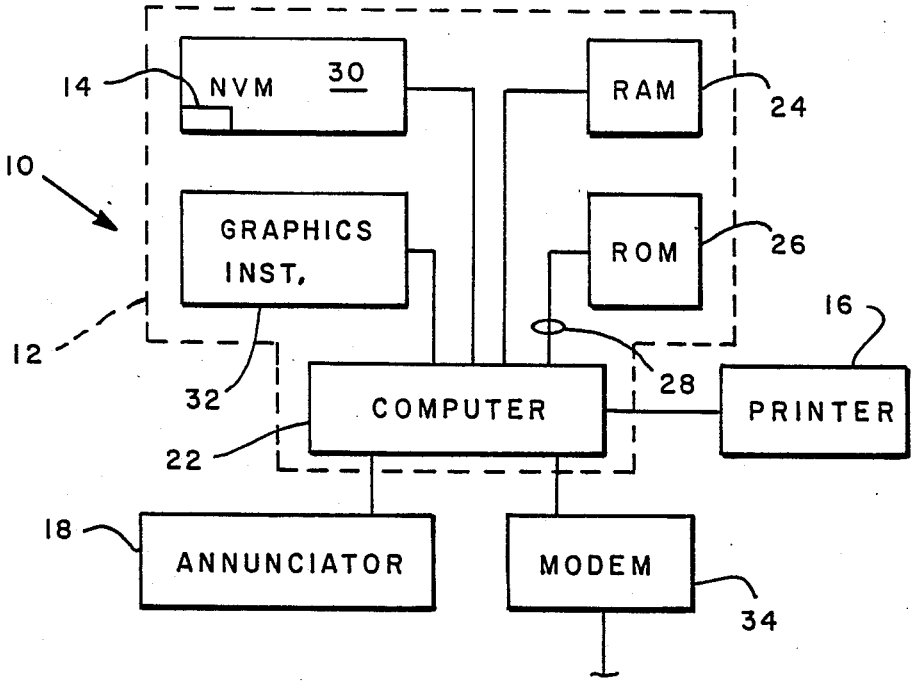
FIG. 1—a block diagram of a system, embodying the principles of the present invention, for indicating the balance of stored funds.

A system for indicating the balance of stored funds, generally indicated at 10 in FIG. 1 and embodying the principles of the present invention, includes means 12 for controlling the printing of a graphic pattern, the control means 12 having means 14 for storing information representative of value, and means 16 for printing a graphic pattern. Preferably, the system 10 further includes means 18 for providing an audible output.

In one embodiment, the system 10 is part of a batch mailing system wherein a substantial volume of mail pieces are processed and wherein some form of a statement sheet, detailing various parameters of each batch processed, can be provided. Typical of such a system is that system shown and described in U.S. patent application Ser. Nos. 813,443; 813,459 now U.S. Pat. No. 4,760,532, issued on July 26, 1988; and 813,445 all filed on Dec. 26, 1985. In addition, other features of such a system are shown and described in U.S. patent application Ser. No. 832,803 filed on Feb. 25, 1986 now U.S. Pat. No. 4,760,534, issued on July 26, 1988; Ser. No. 849,622 filed on Apr. 9, 1986; Ser. No. 904,577 now U.S. Pat. No. 4,837,701 filed on Sept. 5, 1986; Ser. No. 904,526 filed on Sept. 5, 1986; and Ser. Nos. 940,102, 940,112, 940,131, 940,110, and 940,103 now U.S. Pat. No. 4,821,195, all filed on Dec. 10, 1986. All of the above referenced patent applications are assigned to the assignee hereof. Although the present system 10 is described with respect to such a batch mailing system, the present system 10 can obviously be used for any sized mailing system and is not in any way restricted to a system that produces a statement sheet or the like.

In general, the batch mailing system and the features thereof described in the above referenced patent applications refer to a system having at least one accounting unit, preferably a secure accounting unit, wherein postal funds to be used for processing batches of mail are stored. Usually the accounting unit of such a system includes a descending register that is decremented each time funds are spent, i.e., each time mail is processed. Typically, the batch mailing system described in these references includes an unsecured printer remote from the accounting unit for printing on mail pieces and a secure printer for printing a passport or statement sheet detailing the parameters of each batch of mail. Further, in such a batch mailing system, funds are electronically transferred to a user location from a central station. Moreover, such a system may include such other features as redistributing received funds throughout a user location, command and control of any fund transfer by a central station or a second remote funding station, the application of a unique number on each mail piece and the application of a graphic pattern on the statement sheet.

In the present system 10, the control means 12 preferably includes some form of a computer 22. Typically, the computer 22 can be a microprocessor such as an Intel 8085 manufactured and marketed by Intel Corporation, Santa Clara, California. Other microprocessors are also commercially available and may also be used to implement the control means.

In one particular embodiment, the control means 12 further includes a Random-Access-Memory 24 (RAM) and a Read-Only-Memory 26 (ROM). In the typical embodiment, these memories, 24 and 26, are in direct connection with the microprocessor bus 28 and are primarily used by the microprocessor for regulating its own operation. That is, the ROM 26 is provided to boot-up the microprocessor during initialization or resetting. Typically, the ROM 26 contains, in fixed form, those basic programs necessary to the initial operation of the microcomputer. The RAM 24 is typically used to store real time data used by the microprocessor during the on line operation thereof.

In the present embodiment, the control means 12 also includes a nonvolatile memory 30 (NVM) that preferably includes a specific area 14 for storing information representing value, for example, a descending register that maintains the balance of postal value within the system 10. Typically, the nonvolatile memory 30 can be a conventional CMOS RAM having a battery backup; The battery, or power supply, may be affixed to the same local substrate as the non volatile memory 30. In addition, the control means 12 includes means 32 for storing graphic instructions that, as described hereinafter, contains different sets of instructions to be printed by the graphic pattern printing means 16 under the control of the computer 22. These graphic instruction sets may typically be stored either in ASCII character strings or in a bit mapped array. However, the use of ASCII character strings is preferred because less memory space is thus required to store the instructions of each particular graphic pattern.

The graphic pattern printing means 16 of the system 10 is preferably a graphic pattern printer that may be any type of printer capable of printing graphic patterns. Typically, this can be a dot matrix printer of any particular type available in the market place.

The computer 22, in the preferred embodiment, is additionally connected to a modem 34 for external communication and, in one embodiment, to some form of an annunciator 18 to provide an audible signal when the stored funds reach a predetermined amount. The modem 34 functions to provide, at the user location, the means for initiating an electronic funds transfer.

Figure 2:
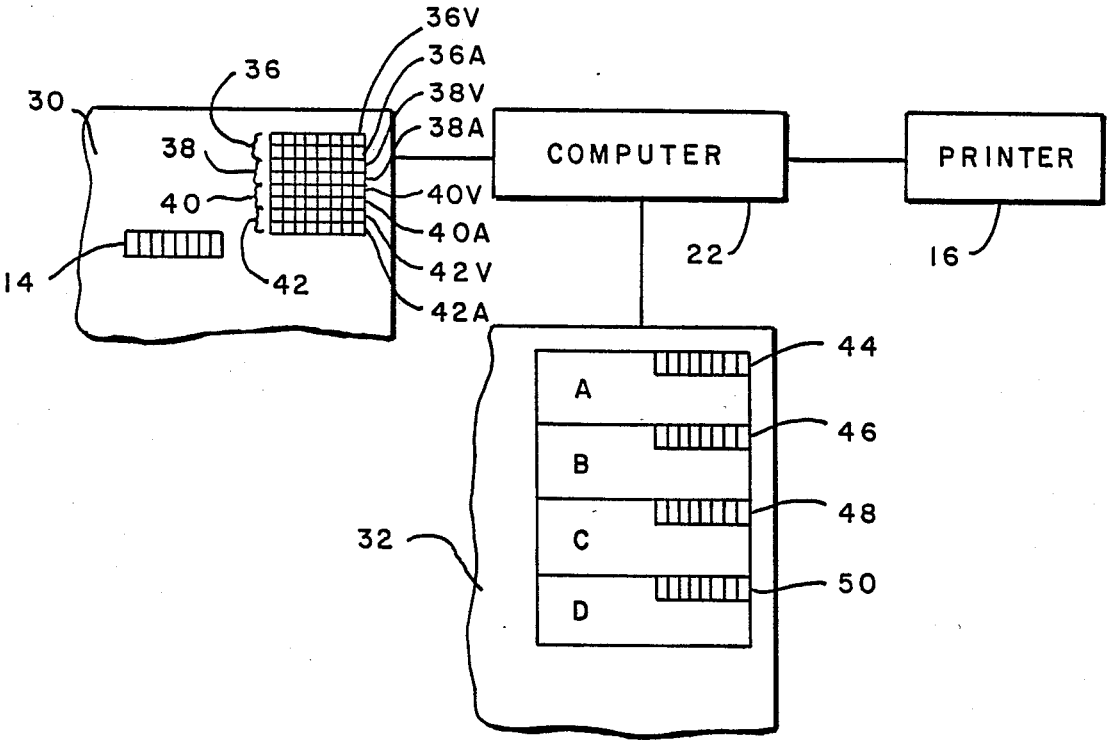
FIG. 2—a more detailed block diagram of a portion of the system shown in FIG. 1 and also embodying the principles of the present invention.

In one specific embodiment, shown in FIG. 2, the nonvolatile memory 30 of the system 10 includes four sets, 36, 38, 40 and 42, of memory blocks, or registers, each set, 36, 38, 40 and 42, thereof including, for example, a value register 36V, 38V, 40V and 42V, and an address register, 36A, 38A, 40A and 42A. In addition, the nonvolatile memory 30 includes the descending register 14 that, in the general system, can be used for keeping a continuous track of the remaining postal value.

Figure 3A:
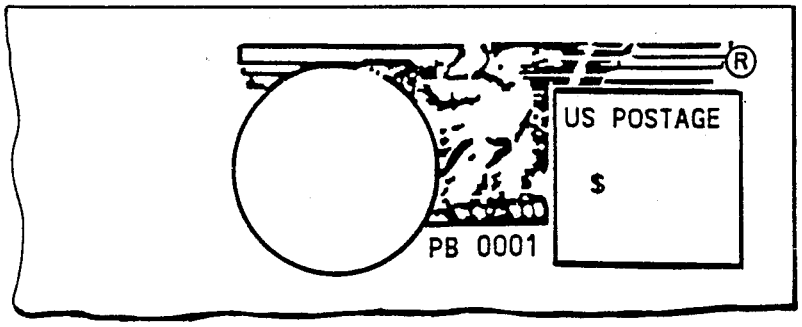
FIGS. 3A to 3D—are exemplary graphic patterns altered to show different balances of stored funds in accordance with the operation of the system shown in FIG. 1.
Figure 3B:
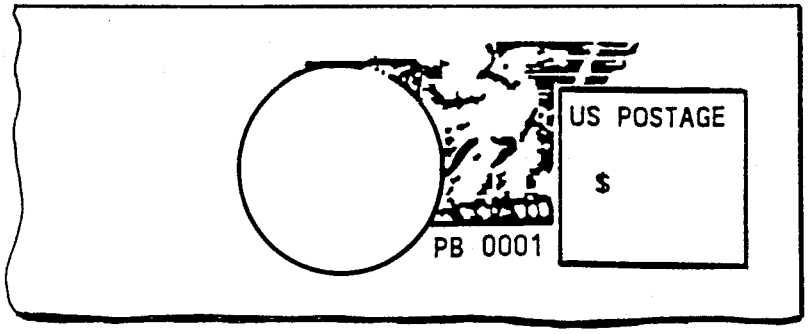
Figure 3C:
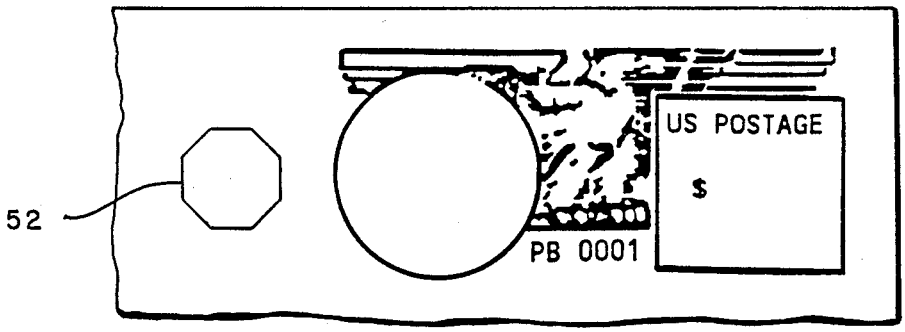
Figure 3D:
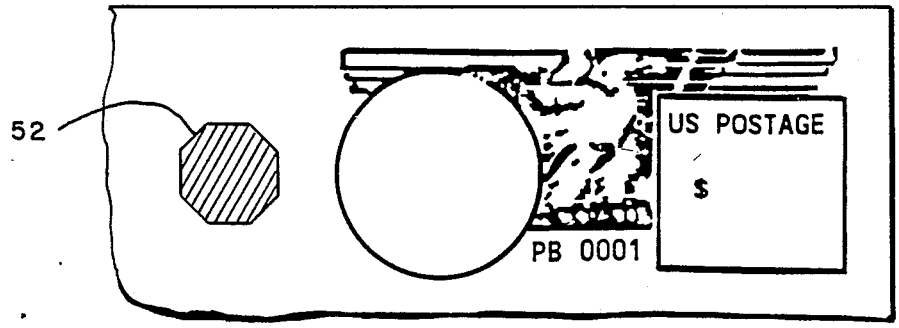

In the embodiment shown in FIG. 2, the graphics instruction memory 32 includes four blocks of graphic instruction sets labeled A, B, C and D each having an address 44, 46, 48 and 50 that is identical to one of the addresses, 36A, 38A, 40A and 42A, respectively, associated with one of the sets of registers, 36, 38, 40 and 42, respectively, in the nonvolatile memory 30. For exemplary purposes, the blocks of memory in the graphics instruction memory, labeled A, B, C and D, preferably represent instructions utilized by the computer 22 to command and control the printer 16 to print the corresponding patterns depicted in FIGS. 3A, 3B, 3C and 3D, respectively. In this particular embodiment, FIG. 3A is a pictorial representation of a valid indicia that can be utilized either on each of a plurality of mail pieces or imprinted upon a statement sheet if such a statement sheet is used to authenticate and/or verify payment of postage value for the mailing of a batch or batches of mail pieces. This particular representation is a registered trademark of Pitney Bowes Inc., Stamford, Connecticut. FIG. 3B is an indicia similar to that shown in FIG. 3A but with a portion of the wings of the eagle removed, such a change would be readily noticeable to the most casual observance of a mailroom operator. FIG. 3C is similar to the indicia of FIG. 3A but includes a further graphic portion 52 therewith. As shown in FIG. 3C and D, it is preferred that the additional graphics are applied to the left hand side of the graphics pattern. In this example, the additional graphic portion 52 is an octagon. An octagon effectively connotates the conventional "STOP" sign used in traffic regulation. This connotation provides an ergonomic advantage since a human operator, upon the most casual observance thereof, will tend to direct further attention thereto. The indicia of FIG. 3D is substantially the same as that shown in 3C. However, in this instance, the octagonal portion 52 is, for the sake of showing a distinction only, shaded. Typically, such a distinctive change could include a color change. Of course, other additions are clearly available and the use of an octagon is merely representative of the addition of information to the original graphic pattern.

Before discussing a typical operation of the system 10, it will be understood that the descending register 14 of the nonvolatile memory 30 is inaccessible to the operator of the system insofar as the ability to change the value represented thereby. Further, however, the sets, 36, 38, 40 and 42, of value, 36V, 38V, 40V and 42V, respectively, and address, 36A, 38A, 40A and 42A, respectively, registers are preferably programmable so that each system operator can set various values whereat indications of low funds will occur depending upon his own business situation. For security, if desirable, the addresses and values, since they should be accessible to the operator, may also be placed in the RAM 24 each time the system is started or may, in fact, be written into the Read-Only-Memory 26 (ROM) during start up. Alternatively, the ROM 26 may be provided with customer selected values by the manufacturer of the system 10 or the control means 12.

Figure 4:
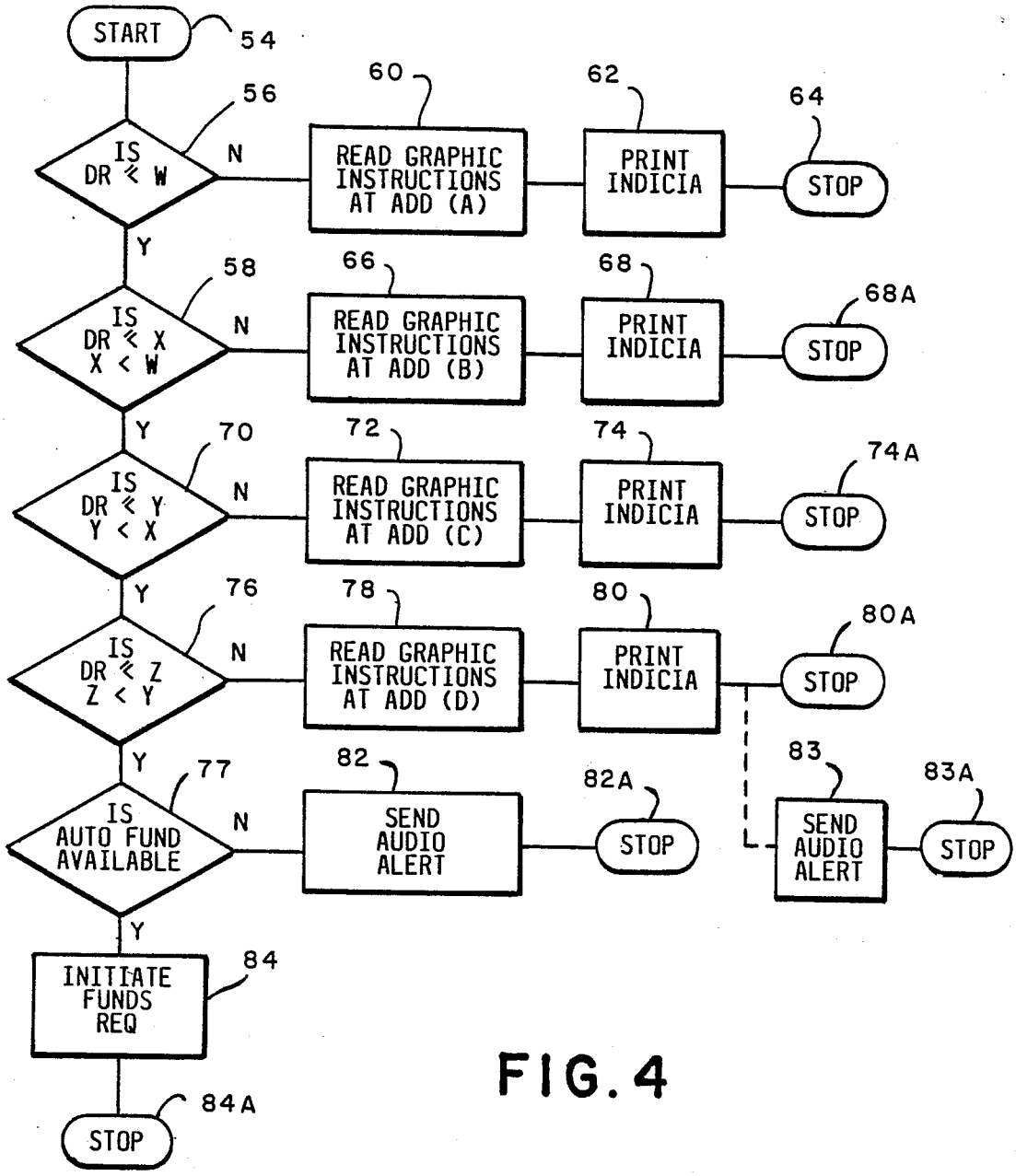
FIG. 4—an exemplary flow diagram depicting the operation of one embodiment of a system embodying the principals of the present invention.

In any event, the system 10 preferably operates in general accordance with the flow diagram set forth in FIG. 4. In this diagram the start block 54 represents that point in time in the mailing process when the computer 22 is prepared to activate the printer 16 to print an indicia. In a very large mailing system utilizing a statement sheet the appropriate timing for the printing of an indicia would be at, or near, the end of the processing of a particular batch of mail. In a comparatively smaller system, wherein each mail piece has an indicia applied thereto, the indicia would be applied as each mail piece is processed. Nonetheless, at some point in time the computer 22 will issue a command to print an indicia. From this starting point the computer 22 then accesses the value representation stored, for example, in value register 36V and compares, block 56, that value, for example, a value W, to the value representation stored in the descending register 14. If the value represented in descending register 14 is less than the particular value W, the computer 22 proceeds, in this embodiment, to the next test, block 58. As used herein, and as shown in the flow chart, the actual comparison could include the testing for a value that is less than or equal to the value W. However, as long as the comparison for a value of "less than" is made the system 10 operates effectively. If the value in a descending register 14 is not less than the selected value W stored in register 36V, then the computer 22 will access, block 60, the graphics instructions at address register 36A and print the indicia, block 62, shown in FIG. 3A. The computer 22 then stops, block 64, until the next print command. In this discussion, the value representation stored in register W is the largest remaining value that will initiate a change in the indicia.

In the event that the value represented in the descending register 14 is, in fact, less than the preselected value W, a second comparison, block 58, can be provided to compare the value represented by the descending register against a second preselected value X where X is less than W. "Thus, assuming the provision of an additional comparison block 70, if the value represented in the descending register 14 is less than the particular valve X, the computer 22 proceeds to the next test block 70. Also, as used in this embodiment and as shown in the flow chart, the actual comparison could include testing for a value that is less than or equal to the value of X, block 58, but as long as the comparison for a value of 'less than' in made, the system operates effectively. Again, if the value in a descending register is less than W but not greater than the selected value X stored in register 38V, then the response will be such that the graphic instructions stored in address register 38A will be accessed, block 66, to print the indicia, block 68, depicted in FIG. 3B. Whereupon computer processing stops, block 68A. At this point in time the operator, observing that the indicia has been changed, should recognize that the value in the descending register 14 is reaching a relatively low critical value and that further funds should be obtained. Accordingly, assuming the provision of multiple comparisons such as, for example, a third and fourth comparison, if the value in the descending register 14 is not greater than the particular selected value X, block 58, processing would proceed to test block 70. Further, if the value in the descending register 14 is not greater than the particular selected value Y, block 70, processing would proceed to test block 76. And, if the value in the descending register 14 is not greater than the particular selected value Z, block 76, processing may proceed to test block 77, assuming the provision of such a test block (77), or directly to block 84 for causing funds initiation. Assuming the provision of block 77, if automatic refunding is available, an audio alert, block 82, is sent, followed by processing being stopped, block 82A. Accordingly, the basic comparison described above can be implemented to allow the operator a plurality of different indications relative to the balance of the funds such as, comparing, block 70, a value Y stored in register 40V being less than X to access the pattern in register 40A, block 72, and command the printer to print, block 74, the indicia depicted in FIG. 3C and the subsequent comparison, block 76, to value Z, Z being less than Y, to access the pattern in register 42A, block 78, and command the printing, block 80, of the indicia depicted in FIG. 3D.

Ultimately if no corrective action is taken, the last comparison should be set such that the operator must proceed to request or initiate a funds request, block 84, automatically, block 72 if such is available. In one embodiment, in addition to the final change in the indicia as shown in FIG. 3D an audio alert, block 83, is provided via the annunciator 18 shown in FIG. 1 and in block 82 when Autofunding is not available. Each print indicia operation, blocks 62, 68, 74 and 80 are followed by a stop, 64, 68A 74A and 80A respectively. Each audio alert 82 and 83 are also followed by a stop 82A and 83A respectively.

The range of values for the selected indicator levels can range from between a million dollars to a few hundred dollars during critical periods of operation and depending upon the size of the mailing operation involved. One advantage of the system 10, as described herein, is that the operator of the system 10 is provided with a visual and/or audible indication when the funds stored in the system 10 reach a critical level below which, without replenishment, an untimely stoppage of work and concomitant loss of equipment time could result.

In view of all of the above, there has been described, in a mailing system of the type having stored funds: means for changing an indicia to be printed when the amount of said stored funds is less than a preselected fund level; alone, or in combination with, said means for changing an indicia comprising means for controlling the printing of said indicia, and means, connected to said controlling means, for storing at least one preselected fund level representation.

Further, said combination may additionally include: means, connected to said controlling means, for storing at least two different graphic pattern instruction sets, alone, or in combination with, each said preselected fund level representation having an address associated therewith, and each said address being associated with one of said graphic pattern instruction sets; or said system may additionally include means for causing an audible indication when said level of said stored funds is less then said preselected funding level, said audible indication means being connected to said controlling means; or means, connected to said control means, for printing said indicia.

In addition there has been described, in a mailing system of the type having stored funds: means for changing an indicia to be printed when the amount of said stored funds is less than a preselected fund level, in combination with means for causing an audible indication when said level of said stored funds is less than said preselected funding level.

Moreover, there has been described a system for indicating a funding level, which said system comprises: means for controlling the printing of an indicia; means, in communication with said indicia printing control means, for storing at least one preselected fund level; means, in communication with said indicia printing control means, for storing a current balance of funds; and means for changing said indicia when said current balance reaches said preselected fund level; alone or in combination with (a) said control means including a computer, and said computer having a random access memory and a read only memory connected thereto; or (b) said means for storing a current balance of funding is a descending register in a nonvolatile memory; or (c) each said preselected fund level representation has an address associated therewith, each said address being associated with one of said graphic pattern instruction sets; or, in combination with item (c): means for causing an audible indication when said level of said stored funds is less that said preselected funding level, said audible indication means being connected to said controlling means, alone or in combination with means, connected to said control means, for printing said indicia.

Still further, there has been described a method of indicating the balance of stored funds comprising the steps of: storing at least one preselected fund level; comparing one of said preselected fund levels with said balance of stored funds; and printing an indicia, said indicia printed being indicative of said balance of stored funds; alone or in combination with: (a) selecting, depending on the results of said comparing step, one of a plurality of indicia to be printed; or (b) providing, when said balance of stored funds reaches one of said preselected fund levels, an audio output; or (c) comparing said balance of stored funds with at least two different preselected fund levels.

Although the present invention has been described with respect to a particular embodiment, it will be understood that other arrangements and configurations may also be developed that nevertheless do not depart from the spirit and scope of the present invention. Hence, the present invention is deemed limited only by the appended claims and the reasonable interpretation thereof.

What is claimed is:

1. A method of alerting an operator of a mailing system including memory means, having stored therein a current level of funds which are available to be dispensed, that the current level is not greater than a selected level, said method comprising the steps of:

a. storing a plurality of sets of instructions for printing a corresponding plurality of different graphic patterns;
b. storing at least one preselected fund level;
c. comparing said at least one preselected fund level with said current level of stored funds;
d. printing a first one of said graphic patterns when the current level is greater than any preselected level, and printing a second one of said graphic patterns in response to said comparison indicating that the current level is not greater than a first preselected level.

2. The method according to claim 14 including the steps of providing annunciator means for providing an audible signal, and causing said annunciator means to provide an audible signal when the comparison indicates that said current level is not greater than said at least one preselected level.

3. The method according to claim 14 including the step of automatically refunding said current level when the comparison indicates that the current level is not greater than a second preselected level.

4. In a mailing system including means for accounting for funds, wherein the accounting means includes a descending register for storing a current level of funds available to be dispensed, said system including means for dispensing respective values of said funds, and said accounting means including means for decrementing the current funds level stored in the descending register by respective amounts corresponding to respective values dispensed, an improvement for alerting an operator of the system that the current level of funds available to be dispensed is not greater than a selected level, the improvement comprising:

a. means for storing a plurality of sets of instructions for printing a corresponding plurality of different graphic patterns;
b. means for printing; and
c. means for controlling the printing means, the controlling means including means for causing the printing means to print a first one of said graphic patterns when the current level of funds is greater than a first selected level, and the controlling means including means for causing the printing means to print a second one of said graphic patterns when the current level of funds is not greater than said first selected level.

5. The improvement according to claim 4 including annunciator means for providing an audible signal, and means for causing said annunciator means to provide the audible signal when the current level of funds is not greater than said first selected level.

6. The improvement according to claim 4 including means for storing said first selected level, said first selected level having an address associated therewith, and said second one of said graphic patterns having said address associated therewith.

7. The improvement according to claim 4 including means for automatically increasing the total of the current level of funds when the current level thereof is not greater than a second selected level.

8. The improvement according to claim 4 including annunciator means for providing an audible signal, and means for causing said annunciator means to provide said signal when the current level of funds is not greater than a second selected level.

9. The improvement according to claim 4 including computer means, said computer including said accounting means and dispensing means and controlling means, and said dispensing means including means for causing said printing means to print dispensed values of said funds.

10. The improvement according to claim 4, wherein the controlling means includes means for causing the printing means to print a third one of said graphic patterns when the current level of funds is not greater than a second selected level which is less than said first selected level.

11. The improvement according to claim 10, including means for storing said first and second selected levels, said first and second selected levels each having a different address associated therewith, said second one of said graphic patterns having an address associated therewith which corresponds to the address of said first selected level, and said third one of said graphic patterns having an address associated therewith which corresponds to the address of said second selected level.

12. The improvement according to claim 10 including annunciator means for providing a plurality of audible signals, and means for causing the annunciator means to provide a first one of said audible signals when the current level of funds is not greater than said first selected level and to provide a second audible signal when the current level of funds is not greater than said second selected level.

* * * * *